US007775389B2

(12) United States Patent
Higgins

(10) Patent No.: US 7,775,389 B2
(45) Date of Patent: Aug. 17, 2010

(54) CLOSURE FOR CONTAINERS

(75) Inventor: Phillip Higgins, Glen Waverley (AU)

(73) Assignee: Poppet International Pty Ltd, Melbourne, Victoria (AU)

( * ) Notice: Subject to any disclaimer, the term of this patent is extended or adjusted under 35 U.S.C. 154(b) by 0 days.

(21) Appl. No.: 11/384,001

(22) Filed: Mar. 17, 2006

(65) Prior Publication Data

US 2007/0228001 A1 Oct. 4, 2007

(51) Int. Cl.
*B65D 51/18* (2006.01)
*B65D 41/32* (2006.01)

(52) U.S. Cl. ..... 220/212; 220/254.1; 220/266

(58) Field of Classification Search ..... 220/265, 220/276, 296, 289, 691, 257.1, 256.1, 254.1, 220/FOR. 203, FOR. 205; 215/316, 254, 215/224, 251, 201, 200; 222/544
See application file for complete search history.

(56) References Cited

U.S. PATENT DOCUMENTS

| | | | | | |
|---|---|---|---|---|---|
| 1,691,394 | A | * | 11/1928 | Heinrich | 220/276 |
| 2,772,802 | A | * | 12/1956 | Woydatt et al. | 215/256 |
| 3,300,073 | A | * | 1/1967 | Benz | 215/253 |
| 3,430,777 | A | * | 3/1969 | Esposito, Jr. | 215/256 |
| 3,592,351 | A | * | 7/1971 | Johnson et al. | 220/257.2 |
| 3,606,063 | A | * | 9/1971 | Childs et al. | 215/330 |
| 3,707,240 | A | * | 12/1972 | Wilson | 215/256 |
| 3,858,742 | A | * | 1/1975 | Grussen | 215/253 |
| 4,043,475 | A | * | 8/1977 | Wheeler | 215/223 |
| 4,098,419 | A | * | 7/1978 | Virog et al. | 215/252 |
| 4,470,513 | A | * | 9/1984 | Ostrowsky | 215/252 |
| 4,901,873 | A | * | 2/1990 | Weiler | 215/48 |
| 5,076,453 | A | * | 12/1991 | Odet | 215/252 |
| 5,249,704 | A | * | 10/1993 | Boetzkes | 220/724 |
| 5,472,106 | A | * | 12/1995 | Nofer | 215/256 |
| 6,739,466 | B1 | * | 5/2004 | Culley | 215/252 |
| 2005/0127023 | A1 | * | 6/2005 | Mockli et al. | 215/256 |

FOREIGN PATENT DOCUMENTS

| | | | |
|---|---|---|---|
| GB | 2073160 A | * | 10/1981 |
| WO | WO 98/46191 | | 10/1998 |

* cited by examiner

*Primary Examiner*—Anthony Stashick
*Assistant Examiner*—Robert J Hicks
(74) *Attorney, Agent, or Firm*—Knobbe Martens Olson & Bear LLP

(57) ABSTRACT

A closure for a container is injection moulded from plastics material and comprises (a) a body 61 that has a top wall 5 that has a central opening 7 and (h) a cap 9 that closes the opening 7 when the closure in an operative position on the container. The closure also comprises a region of reduced wall thickness 11 that defines a fracture line that facilitates separation of the cap from the closure. The cap 9 has two diametrically opposed inwardly projecting tabs 23 that cause a greater amount of post-moulding shrinkage than the adjacent parts of the cap after injection moulding of the closure. Consequently, the tabs 23 place a section of the region of reduced wall thickness that in alone to the tabs 23 in tension whereby this section preferentially fractures when a person applies force to separate the cap from the closure.

18 Claims, 7 Drawing Sheets

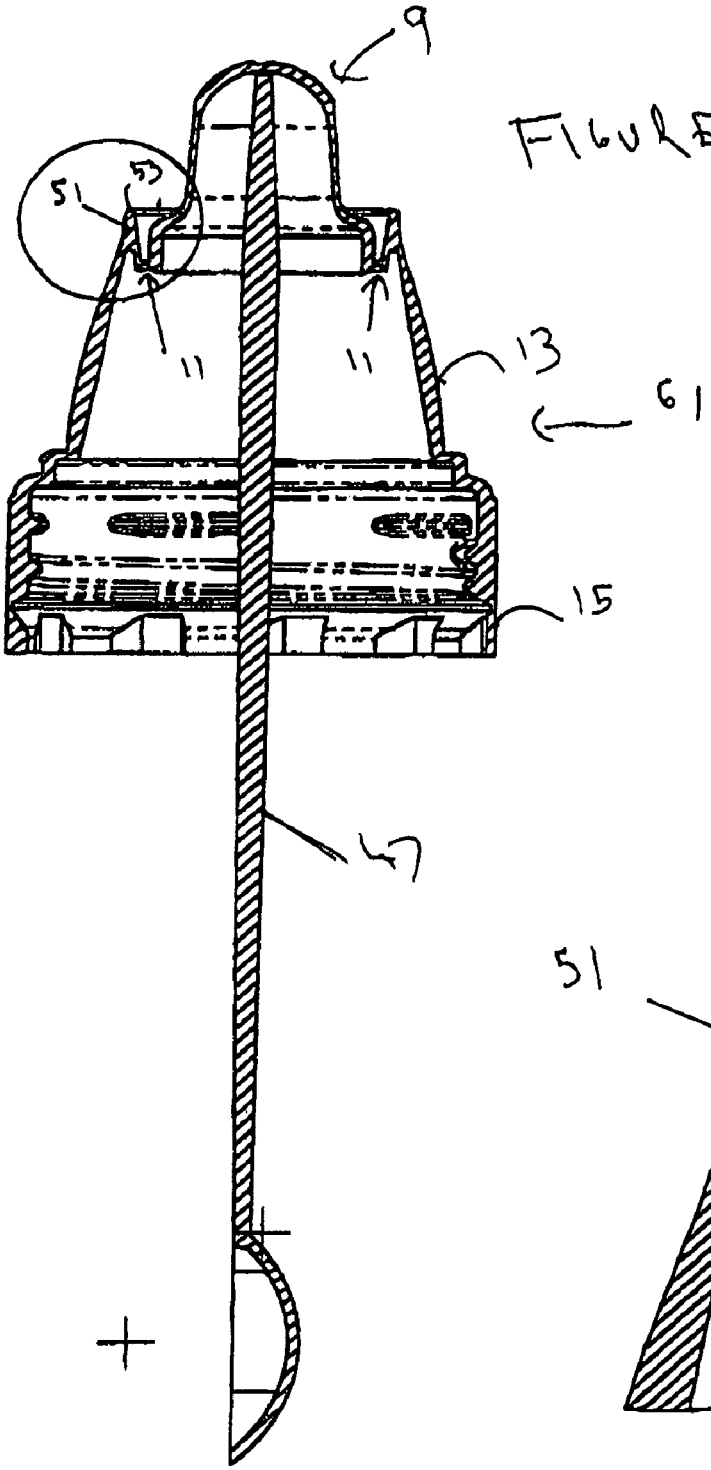
FIGURE 10
FIGURE 11
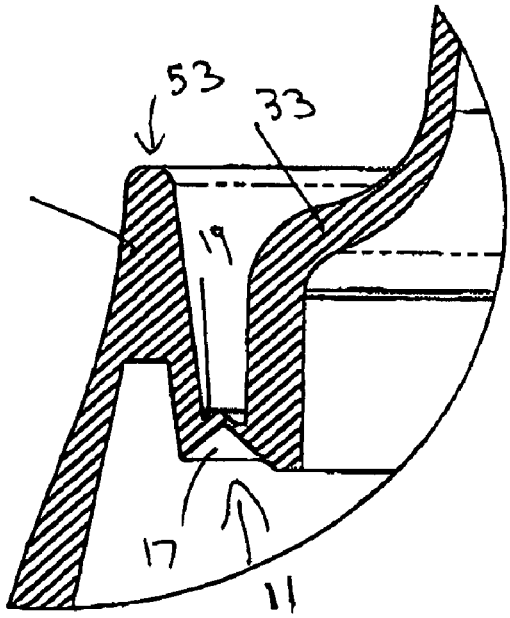

CLOSURE FOR CONTAINERS

The present invention relates to closures for containers.

More particularly, the present invention relates to closures of the type that can be detached from an operative position on a container by a "snap-off" action.

The term "operative position" is understood herein to mean a position in which the closure closes an opening of a container through which the contents of the container can be dispensed.

International application PCT/AU98/00243 in the name of Andrew Mules and James Mitchell discloses drink containers that include a number of different forms of such closures.

The above-described snap-off action closures and the containers may be formed as separate components and thereafter assembled together.

In such situations, typically, the containers have externally-threaded necks that retain the closures on the containers. In addition typically, the closures comprise (a) top walls that have openings that define the container openings when the closures and the containers are assembled together, (b) caps that are connected to the top walls in the as-manufactured forms of the closures and close the openings and can be detached from the top walls (and therefore the containers) by a snap-off action, and (c) internally-threaded annular side walls that depend from the top walls and cooperate with corresponding externally-threaded sections on the necks of the containers and retain the closures on the containers. In use, the containers are filled with products and the closures are positioned on the container necks to close the containers.

Alternatively, the snap-off action closures may be integrally formed as part of the containers and, in use, can be detached from the containers by a snap-off action. Typically, such one-piece arrangements are formed with open bottom ends that can be closed after the containers have been filled with products.

The present invention is concerned with providing a closure that can be detached from an operative position (in which the closure closes an opening of the container) by a snap-off action, with a lower applied force than is required for snap-off action closures known to the applicant.

According to the present invention there is provided a closure for a container that can be detached from an operative position in which the closure closes an opening of the container by a "snap-off" action, the closure being injection moulded from plastics material and comprising: a cap that closes the container opening when the closure is in the operative position on the container, a region of reduced wall thickness that defines a fracture line along which the cap separate from the container when, in use, the closure is in the operative position on the container and a person applies a sufficient force to the cap, and at least one part of the closure that in adjacent to the region of reduced wall thickness has a larger thickness than adjacent parts of the closure whereby the larger thickness part of the closure causes a greater amount of post-moulding shrinkage than the adjacent parts after injection moulding of the closure and places a section of the region of reduced wall thickness that is close to the larger thickness part in tension whereby this section preferentially fractures in response to the applied force and initiated fracture along the fracture line.

The present invention makes it possible for a person to detach the cap from the container by a "snap-off" action without the person having to apply an excessive force to the cap.

The use of excessive force can result in damage to the edge that is formed when the cap is detached. The damage may include the formation of jagged edge. In addition, the need to use excessive force to detach the cap can detract from the market acceptance of the closure and the container.

The present invention was made in the context of the realisation by the applicant that, in practice, (a) there is a minimum wall thickness for the region of reduced wall thickness that can be injection moulded successfully and (b) an excessive force has to be applied by a person in order to fracture this minimum wall thickness and thereby separate the cap from the container.

The present invention is also based on the realisation by the applicant that providing at least one part of the closure, that is adjacent to the region of reduced wall thickness with a larger thickness than adjacent parts of the closure produces a greater amount of post-moulding shrinkage than the adjacent parts after injection moulding the closure and places a section of the reduced wall thickness that is close to the larger thickness part in tension and thereby reduces the applied force that is required to initiate fracture of this section of the reduced wall thickness.

This is a significant advantage because it means that excessive force is not required to initiate fracture.

In this connection, once the region of reduced wall thickness is fractured at one location, a considerably lower applied force is required to detach the remainder of the cap.

The closure and the container may be formed as separate components and thereafter assembled together.

With this arrangement, preferably the closure also comprises a body that has an opening in an upper section thereof that is closed by the cap in the injection moulded form of the closure with the region of reduced wall thickness being part of the body and interconnecting the body and the cap.

Preferably the body comprises an annular internally-threaded side wall and the container has a neck and is externally-threaded so that the body can be threaded onto the neck and thereby retain the closure on the container.

The fracture line defined by the region of reduced wall thickness may be continuous or discontinuous.

Preferably the region of reduced wall thickness includes a groove in a lower surface of the body that reduces the thickness of the body at the location of the groove to a thickness that is less than the minimum thickness of adjacent sections of the body.

Preferably the lower groove is V-shaped.

Preferably the lower groove has a sharp apex. This feature contributes to ensuring that the edge of the body that is formed when the cap in detached from the body does not have jagged sections that could injure a person.

Preferably the region of reduced wall thickness in also defined by a groove in an upper surface of the body that is positioned outboard or inboard of the lower surface groove so that the section of the body that separates the grooves defines a band that has a minimum thickness that in less than the minimum thickness of the adjacent sections of the body.

Preferably the upper groove is outboard of the lower groove.

Preferably the grooves are circular and the band that separates the grooves is a frusto-conical band.

Preferably the moulded polymeric material in the band in aligned in a direction that is parallel to the surfaces of the band.

Preferably the upper groove is V-shaped.

Preferably the larger thickness part of the closure is part of the cap.

Preferably the larger thickness part of the cap is in the form of an inwardly extending projection.

Preferably the cap has a side wall that extends from the region of reduced wall thickness in the injection moulded form of the closure and the larger thickness part of the cap is in the form of a projection that extends inwardly from the cap side wall.

Preferably the cap comprises a pair of opposed inwardly extending projection.

Preferably the cap comprises a pair of opposed wings.

Preferably the wings are perpendicular to the projections.

Preferably the skirt has an internal thread to engage an external thread on a neck of a container.

According to the present invention there in also provided an assembly of the above-described closure and container.

According to the present invention there is also provided a container with an integrally formed closure of the type described above.

The present invention is described hereinafter by way of example with reference to the accompanying drawings, of which:

FIGS. 1 and 2 are perspective views of one embodiment of a closure in accordance with the present invention;

FIG. 3 in a side elevation of the closure;

FIG. 4 in a cross-section along the line 4-4 of FIG. 3;

FIG. 10 is a cross-section through an as-moulded closure shown in FIGS. 8 and 9;

FIG. 11 is a detailed view of the circled region in FIG. 10; and

Figure 12:
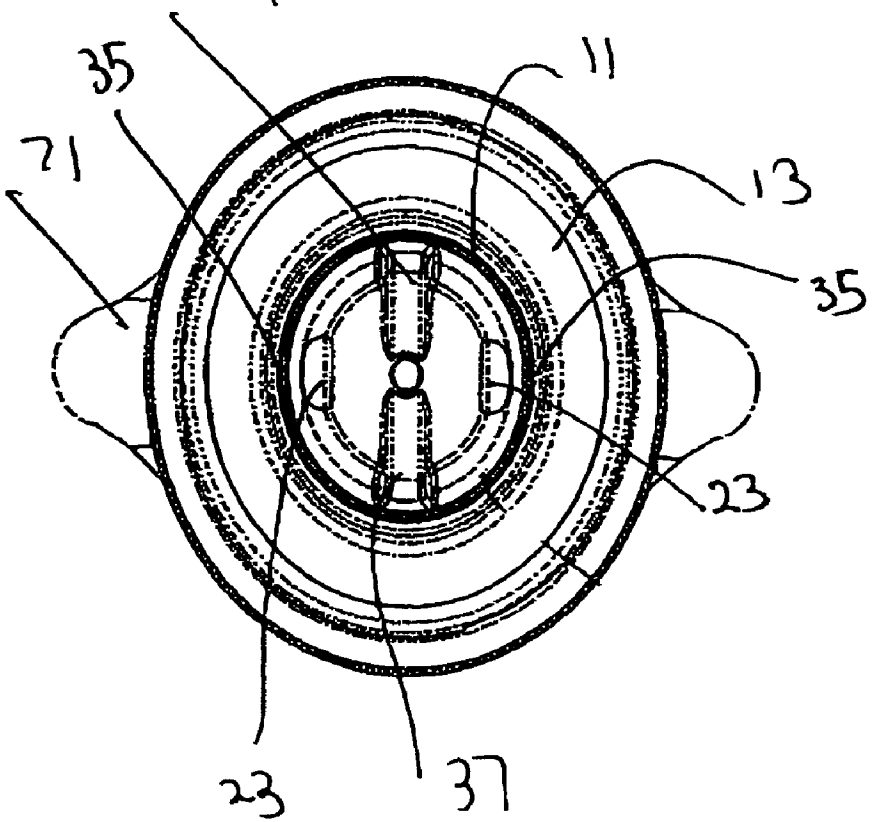

FIG. 12 in a top plan view of the closure shown in FIGS. 8 to 11.

The closure shown in FIGS. 1 to 7 is suitable for use with a container (not shown) that contains a liquid and has an externally-threaded neck that defines an opening of the container.

The closure is injection moulded from a suitable plastics material and comprises:

(a) a body 61 that includes:

(i) a top wall 5 that has a central opening 7;

(ii) an internally-threaded side wall 13 that depends from the outer periphery of the top wall 5 and is formed to locate the closure on the container neck by screw threaded engagement of the respective threaded portions of the side wall 13 and the container neck; and (iii) a tamper evident band 15 connected to the side wall 13; and (b) a cap 9 that closes the opening 7 and is connected to the top wall 5 via a circular region 11 of reduced wall thickness formed in the top wall 5.

The reduced wall thickness region 11 in the top wall 5 includes a circular, V-shaped groove 17 in a lower surface of the top wall 5. The lower groove 17 defines a circular fracture line of the closure. In use, the cap 5 detaches from the body 61 of the closure at this line.

The reduced wall thickness region 11 further includes a groove 19 formed in the upper surface of the top wall 5.

The upper groove 19 is concentric with and positioned outwardly of the lower groove 17. The grooves 17, 19 define a frusto-conical band 21 therebetween.

Figure 1:
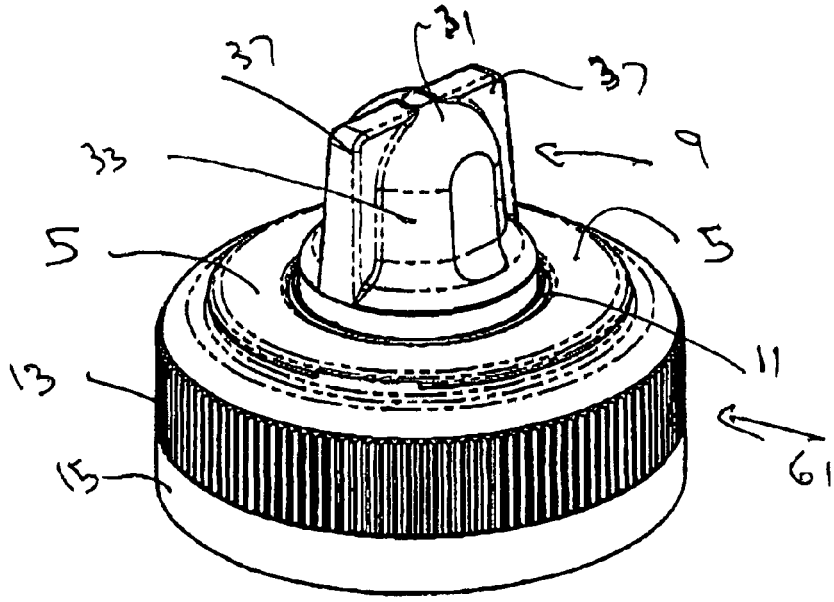
Figure 2:
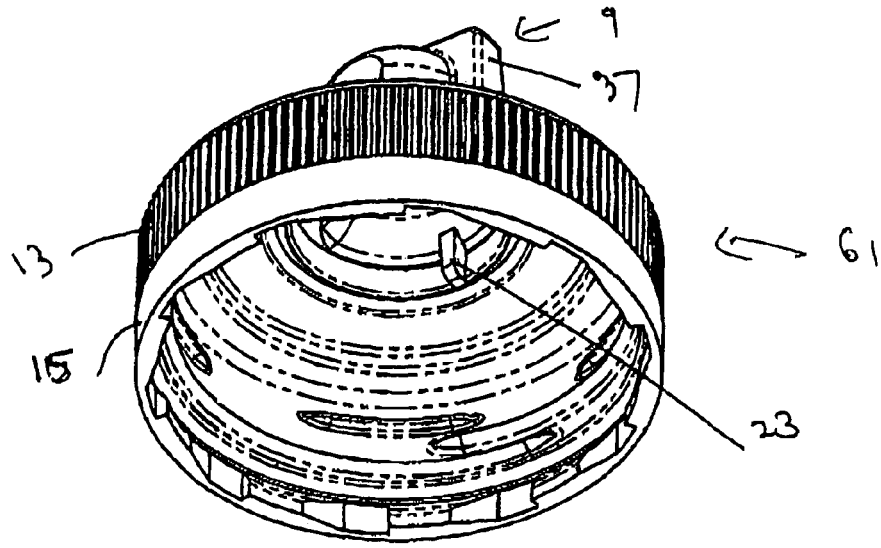
Figure 3:
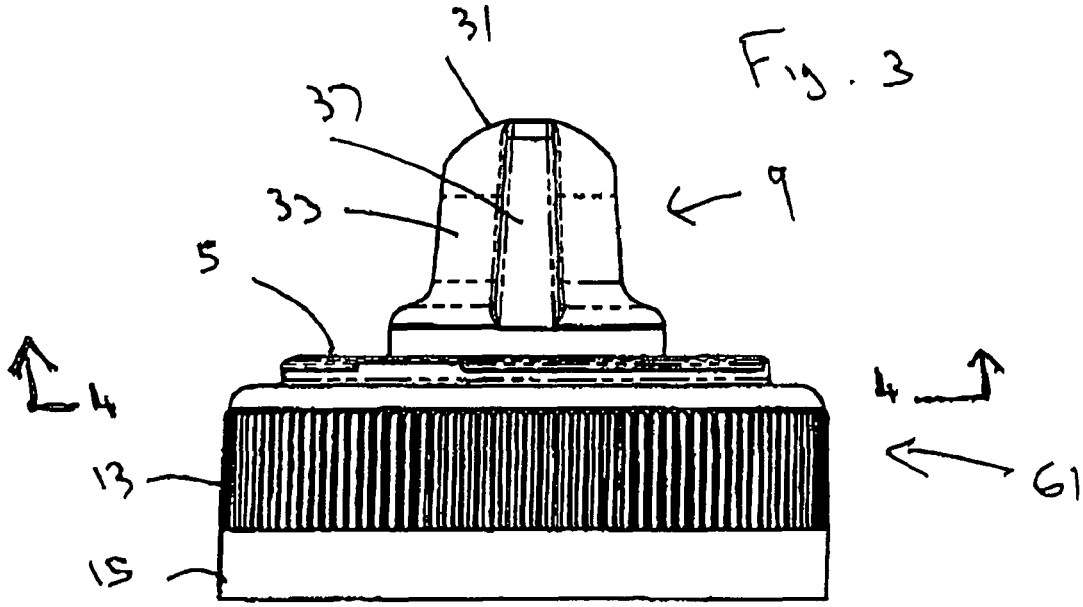
Figure 4:
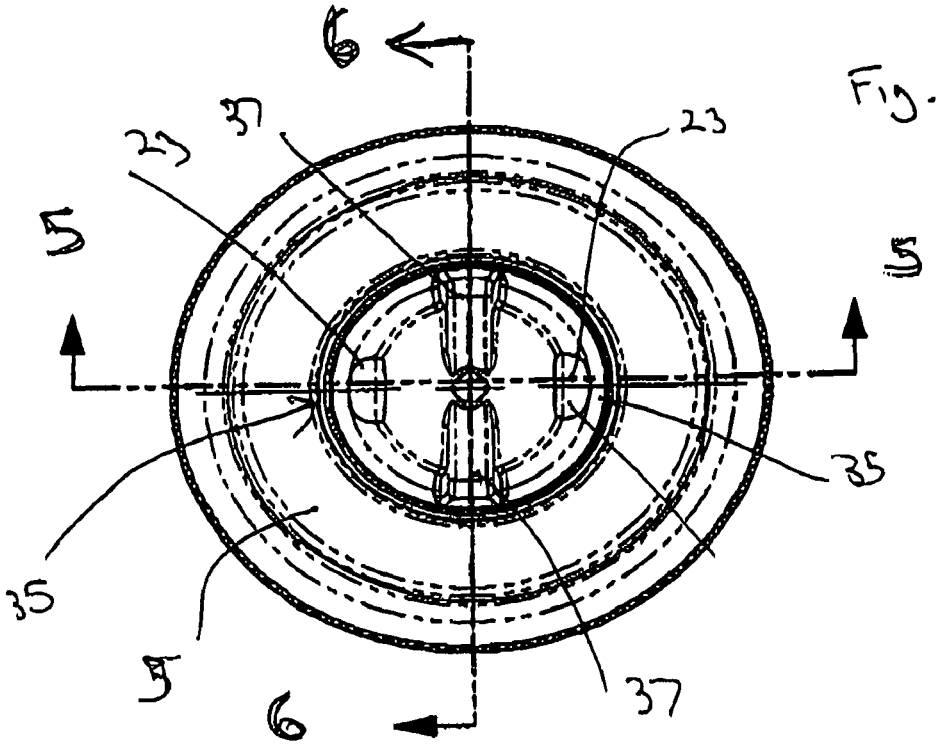
Figure 5:
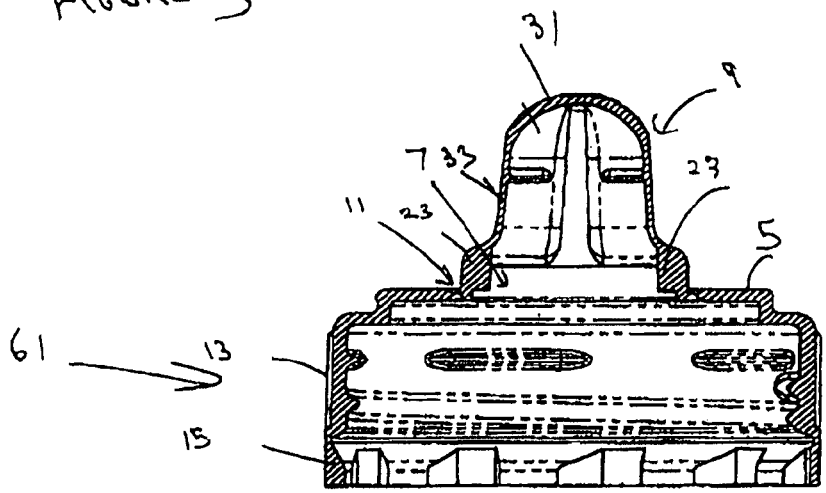
FIG. 5 is a cross-section along the line 5-5 of FIG. 4.
Figure 6:
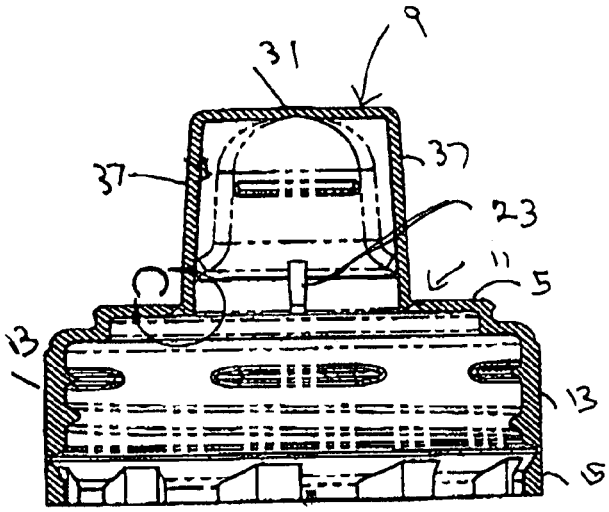
FIG. 6 is a cross-section along the line 4-4 of FIG. 4.
Figure 7:
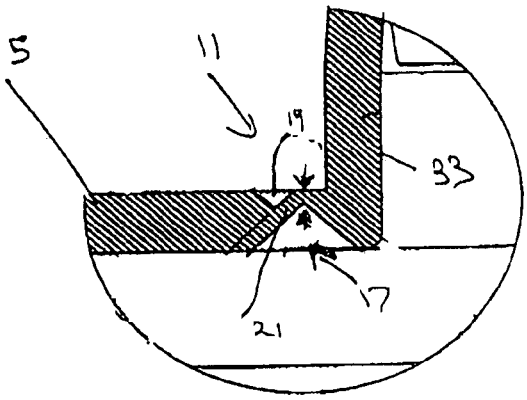
FIG. 7 is a detailed view of the circled region in FIG. 6.
Figure 8:
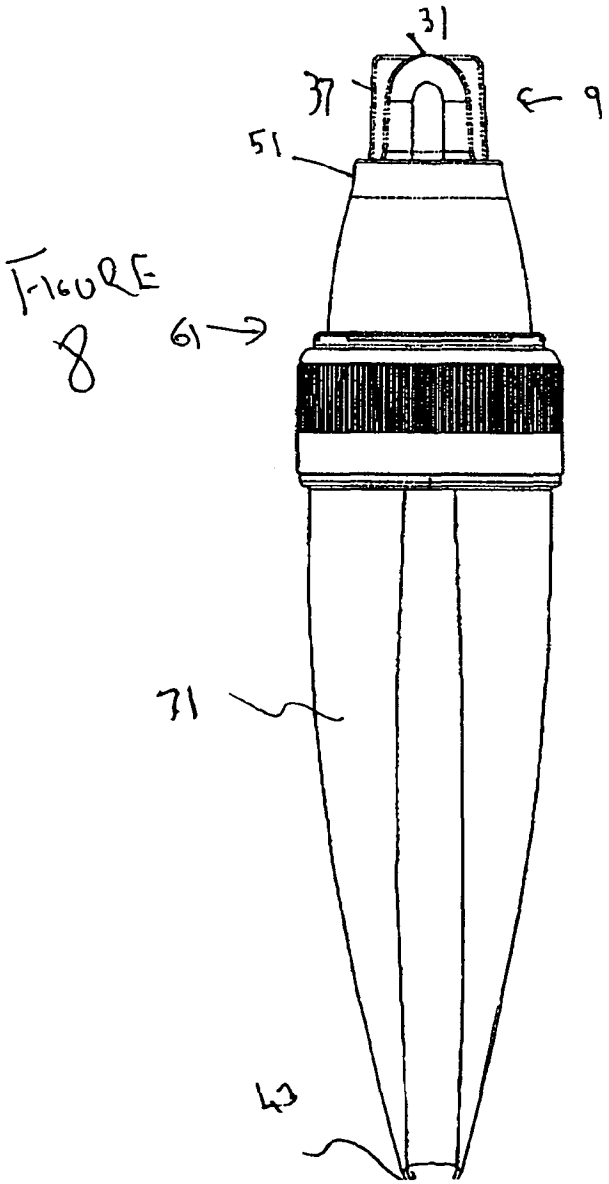
FIG. 8 is a side elevation of another, but not the only other, embodiment of the closure in accordance wish the present invention mounted onto a container and an over cap positioned over the closure.
Figure 9:
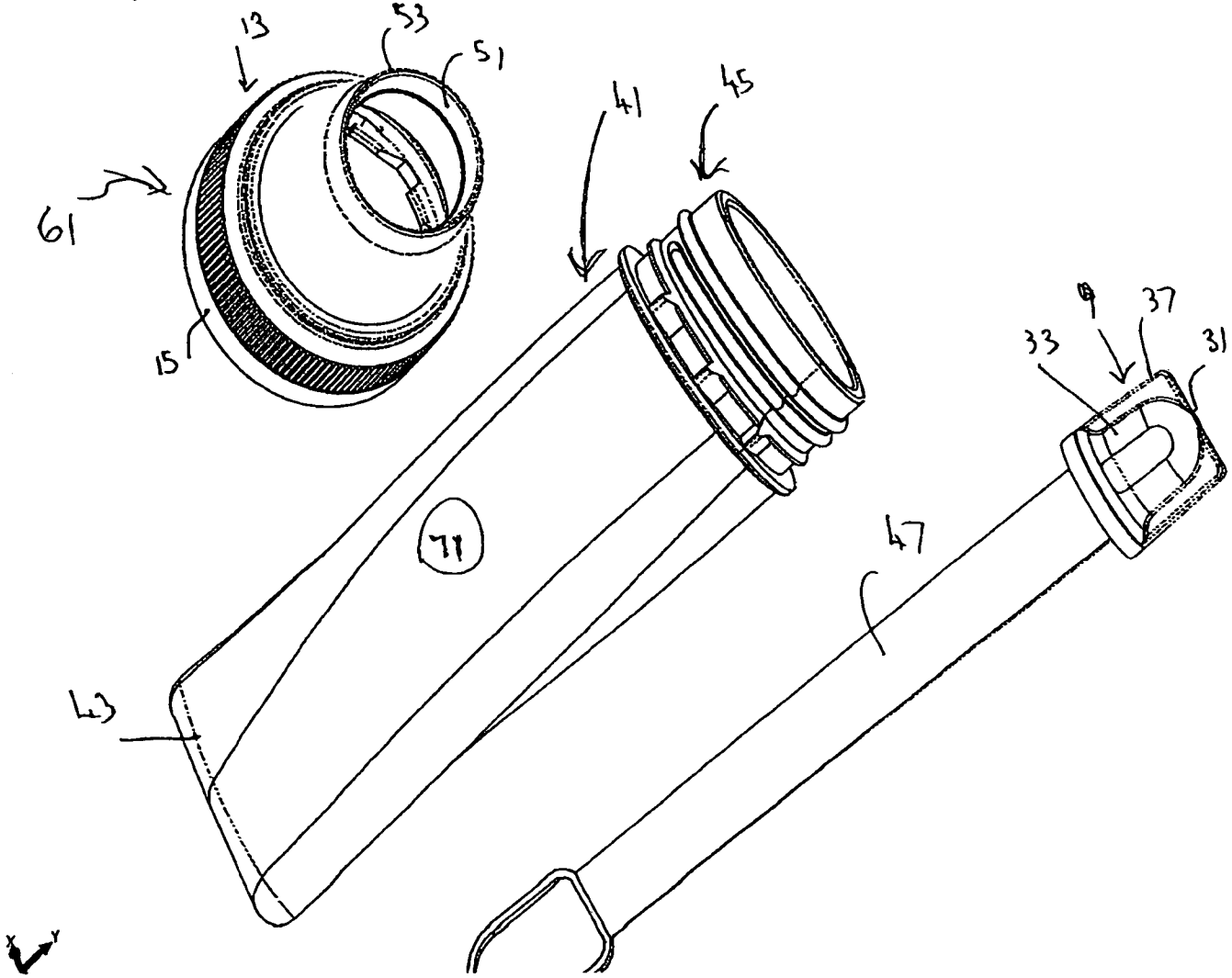
FIG. 9 is a perspective view of the container/closure assembly shown in FIG. 8 which illustrates the cap (with attached spoon) of the closure detached from the body of the closure and these two components of the closure separated from the container.

As is evident from FIG. 7, (a) the minimum thickness of the reduced wall region 11, as measured between an upper surface of the top wall 5 and the apex of the lower groove 19—as indicated by the arrows in FIG. 7—and (b) the minimum thickness of the band 21 are substantially the same and are significantly less than the minimum wall thickness (which is the average wall thickness in this instance) of adjacent sections of the top wall 5.

Typically, the wall thickness of the reduced wall thickness region 11 is selected to be the minimum wall thickness that can be moulded successfully. Typically, the wall thickness is of the order of 0.5 mm.

In order to reduce the applied force that is required to fracture the reduced wall thickness region 11 and thereby detach the cap from the closure, the cap 9 is moulded to selectively place two diametrically opposed sections 35 (FIG. 4) of the reduced wall thickness region 11 in tension. Placing the sections 35 in tension reduce the applied force that is required to initiate fracture of the region of reduced wall thickness 11 at these locations.

In this connection, the cap 9 is generally bell-shaped with a dome-shaped top wall 31 and a side wall 33 that extends outwardly and downwardly from the top wall 31 and merges with the top wall 5.

The side wall 33 of the cap 9 has generally uniform wall thickness, save that the side wall 33 includes two diametrically opposed inwardly projecting tabs 23 that define regions of greater wall thickness that are positioned immediately adjacent to the diametrically opposed sections 35 of the reduced wall thickness region 11.

In practice, there is greater post-moulding shrinkage of the material in the tabs 23 than in the material in the adjacent regions of the side wall 33 after injection moulding the closure. The additional post-moulding shrinkage places the sections 35 of the reduced wall thickness region 11 in tension and thereby reduces the applied force that is required to initiate fracture of the region of reduced wall thickness 11 at these locations.

The cap 9 also includes two diametrically opposed wing formations 37 that extend outwardly and are positioned at 90° to the tabs 23. The wing formations 37 are convenient surfaces against which a person can apply finger pressure to detach the cap 9 from the closure. Positioning the wing formations 37 at an angle of 90° to the tabs 23 means that pressure applied against the flat surfaces of the wing formations 37 has maximum impact on the sections 35 of the reduced wall thickness region 11 and thereby accentuates the advantage obtained by placing the sections 35 in tension.

The closure shown in FIGS. 8 to 12 is conceptually the same as the closure shown in FIGS. 1 to 7 and the same reference numerals are used in the figures to describe the same components.

In this context, it is noted that the body 61 of the closure shown in FIGS. 8 to 12 is formed so that the reduced wall thickness region 11 forms the top wall 5.

The closure is suitable for use with a container 41 in the form of a tube 71 that has a closed end 43 and an open mouth 45 that has an external screw thread. The container is suitable for containing iced drinks and ice cream based products. Specifically, the cap 9 of the closure is formed as the end of a spoon 47 that can be used to remove product from the container and the mouth is relatively wide to facilitate access of the spoon to the interior of the container.

One particular feature of the closure shown in FIGS. 8 to 12 that is not part of the closure shown in FIGS. 1 to 7 is that the side wall 13 of the body 61 of the closure has an annular wall 51 that extends beyond the reduced wall thickness region 11 so that the wall 51 shield the reduced wall thickness region 11 and, more particularly minimises the risk of a person being injured on the edge that forms when the cap 9 is detached from the body 61.

In addition, the annular wall 51 is formed with a rounded rim 53 to further minimise the risk of injury to a person in the event that the person dispenses product from the container by placing the annular wall 51 in his/her mouth and up-ending the container so product can flow downwardly from the container into the person's mouth.

Many modifications may be made to the preferred embodiment of the prevent invention described above without departing from the spirit and scope of the present invention.

By way of example, whilst the embodiments shown in the Figures illustrate the closures and the containers am separate components, the present invention is not so limited and extends to arrangements in which the closures are integrally formed as part of the containers.

In addition, whilst not shown, the closures may also include suitable forms of over caps to protect the caps 9.

The claims defining the invention are as follows:

1. A closure for a container having a portion that can be detached from an operative position in which the closure closes an opening of the container by a snap off action to allow the contents of the container to be dispensed through the opening, the closure being injection moulded from plastics material and comprising:

a closure body that seals around the container opening when the closure is in the operative position on the container, the closure body comprising a top wall with a central opening for dispensing the container contents therethrough;

a cap comprising a side wall connected to the closure body where the cap side wall meets the closure body top wall by a region of reduced wall thickness that defines a fracture line extending around the central opening along which the cap separates from the closure when, in use, the closure is in the operative position on the container and a person applies a sufficient force to the cap; and wherein the cap side wall has a generally uniform wall thickness except that at least one part of the cap side wall that is adjacent to the region of reduced wall thickness has a larger thickness than the generally uniform wall thickness whereby the larger thickness part of the cap side wall causes a greater amount of post-moulding shrinkage than the remainder of the cap side wall after injection moulding of the closure and places a section of the region of reduced wall thickness that is close to the larger thickness part of the cap side wall in tension whereby this section preferentially fractures in response to the applied force and initiates fracture along the fracture line, wherein removal of the cap from the closure body creates an opening in the closure body defined by the fracture line to allow the contents of the container to be dispensed therethrough.

2. The closure defined in claim 1 wherein the closure body has an opening in an upper section thereof that is closed by the cap in the injection moulded form of the closure with the region of reduced wall thickness being part of the body and interconnecting the body and the cap.

3. The closure defined in claim 2 wherein the body comprises an annular internally-threaded side wall and the container has a neck and is externally-threaded so that the body can be threaded onto the neck.

4. The closure defined in claim 2 wherein the region of reduced wall thickness includes a groove in a lower surface of the body that reduces the thickness of the body at the location of the groove to a thickness that is less than the minimum thickness of adjacent sections of the body.

5. The closure defined in claim 4 wherein the lower groove is V-shaped.

6. The closure defined in claim 5 wherein the lower groove has a sharp apex.

7. The closure defined in claim 4 wherein the region of reduced wall thickness is also defined by a groove in an upper surface of the body that is positioned outboard or inboard of the lower surface groove so that the section of the body that separates the grooves defines a band that has a minimum thickness that is less than the minimum thickness of the adjacent sections of the body.

8. The closure defined in claim 7 wherein the upper groove is outboard of the lower groove.

9. The closure defined in claim 7 wherein the grooves are circular and the band that separates the grooves is a frustoconical band.

10. The closure defined in claim 9 wherein the moulded polymeric material in the band is aligned in a direction that is parallel to the surfaces of the band.

11. The closure defined in claim 7 wherein the upper groove is V-shaped.

12. The closure defined in claim 1 wherein the larger thickness part of the cap is in the form of an inwardly extending projection.

13. The closure defined in claim 12 wherein the cap has a side wall that extends from the region of reduced wall thickness in the injection moulded form of the closure and the larger thickness part of the cap is in the form of a projection that extends inwardly from the cap side wall.

14. The closure defined in claim 13 wherein the cap comprises a pair of two opposed inwardly extending projections.

15. The closure defined in claim 14 wherein the cap comprises a pair of opposed outwardly extending wings.

16. The closure defined in claim 15 wherein the wings are perpendicular to the projections.

17. An assembly of the closure defined in claim 1 and a container on which the closure is positioned in an operative position.

18. A container with an integrally formed closure as defined in claim 1.

* * * * *

UNITED STATES PATENT AND TRADEMARK OFFICE

CERTIFICATE OF CORRECTION

PATENT NO. : 7,775,389 B2
APPLICATION NO. : 11/384001
DATED : August 17, 2010
INVENTOR(S) : Phillip Higgins It is certified that error appears in the above-identified patent and that said Letters Patent is hereby corrected as shown below:

At Page 1, Line 4, Item 57, change "(h)" to --(b)--.

At Page 1, Line 13, Item 57, change "in alone" to --is close--.

At Column 1, Line 49, change "separate" to --separates--.

At Column 1, Line 52, change "in" to --is--.

At Column 1, Line 60, change "initiated" to --initiates--.

At Column 2, Line 1, change "edge." to --edges.--.

At Column 2, Line 47, change "in" to --is--.

At Column 2, Line 49, change "in" to --is--.

At Column 2, Line 53, change "in" to --is--.

At Column 2, Line 59, change "in" to --is--.

At Column 3, Line 7, change "projection." to --projections.--.

At Column 3, Line 12, change "in" to --is--.

At Column 3, Line 22, change "in" to --is--.

At Column 3, Line 23, change "in" to --is--.

At Column 3, Line 28, change "wish" to --with--.

At Column 3, Line 40, change "in" to --is--.

At Column 4, Line 28, after "has" insert --a--.

Signed and Sealed this
Third Day of May, 2011

David J. Kappos

David J. Kappos
*Director of the United States Patent and Trademark Office*

At Column 5, Line 16, change “prevent” to --present--.

At Column 5, Line 19, change “am” to --as--.